United States Patent [19]

Trost

[11] 4,149,679

[45] Apr. 17, 1979

[54] PACKAGE LIFT DEVICE

[75] Inventor: Wayne C. Trost, Rockford, Ill.

[73] Assignee: Barber-Colman Company, Rockford, Ill.

[21] Appl. No.: 894,876

[22] Filed: Apr. 10, 1978

[51] Int. Cl.[2] ..... B65H 63/02; B65H 63/08

[52] U.S. Cl. ..... 242/36; 242/37 R; 242/39

[58] Field of Search ..... 242/36, 37 R, 38, 39

[56] References Cited

U.S. PATENT DOCUMENTS

| | | | |
|---|---|---|---|
| 831,564 | 9/1906 | McKean | 242/37 R |
| 1,958,060 | 5/1934 | McKean | 242/37 R |
| 2,665,077 | 1/1954 | Stange | 242/37 R |
| 2,743,063 | 4/1956 | Soussloff et al. | 242/37 R |
| 3,282,517 | 11/1966 | Chavis | 242/37 R |

FOREIGN PATENT DOCUMENTS

| | | | |
|---|---|---|---|
| 912195 | 5/1954 | Fed. Rep. of Germany | 242/37 R |
| 1098866 | 2/1961 | Fed. Rep. of Germany | 242/37 R |
| 63309 | 8/1968 | Fed. Rep. of Germany | 242/37 R |
| 345281 | 4/1960 | Switzerland | 242/37 R |

*Primary Examiner*—Stanley N. Gilreath
*Attorney, Agent, or Firm*—Robert M. Hammes, Jr.

[57] ABSTRACT

A device for automatically lifting a yarn package off of a package drive roll in response to a detected condition has a vertical member depending from a package support and extending through an opening in a lever assembly. The lever assembly is selectively raised by operating means in response to a detected condition and engages the vertical member at the opening by means of the frictional force resulting from a binding action caused by rotation of a portion of the lever assembly with respect to the vertical member. In addition, the lever assembly is biased such that it is disengaged from the vertical member when the downward pressure exerted by the package and package support is relaxed.

12 Claims, 7 Drawing Figures

PACKAGE LIFT DEVICE

BACKGROUND OF THE INVENTION

In general, this invention relates to package lift devices useful in yarn winding apparatus. Specifically, the lift device disclosed herein is particularly useful in connection with the individual yarn winding stations associated with the spinning stations of an open-end spinning machine.

In a typical yarn winding apparatus, a yarn package is held by a package support device in a manner to permit rotation of the package. During winding, the package is held in contact with a rotating package drive roll which in turn causes the package to rotate. In many cases the package support device comprises a pair of parallel support arms which hold the yarn package between them and are pivotally mounted at a point displaced from the yarn package to facilitate raising the package off of the drive roll as necessary. This construction also permits normal movement of the package support as the package becomes larger during the spinning operation.

At times it is desirable to automatically lift the yarn package off of the drive roll when a particular condition exists. For example, if the yarn package remains in contact with the drive roll when a break occurs in the yarn being wound, the broken end becomes entangled in the windings of the package. When this occurs the broken ends must be joined together (pieced-up) so that the winding operation may continue. In order to readily accomplish the piecing-up operation, it is desirable that the broken end associated with the yarn package be easily located. Thus, it is necessary to provide a device which will automatically lift the yarn package off of the drive roll when a yarn break occurs thereby avoiding entanglement in the package.

Once the condition which necessitated lifting the package has been corrected, it is necessary to deactivate the lift mechanism to permit the package to be lowered into contact with the drive roll so that winding may continue. In certain types of textile machines, space limitations result in the need for a simple means of deactivating the lift device which does not depend on manual operation or complex apparatus. For example, in modern open-end spinning machines the spinning stations and corresponding winding stations are very close together and manual resetting of the lift mechanism is difficult. Further, in an open-end spinning machine utilizing automatic piece-up devices, it is necessary to provide a lift mechanism which automatically resets itself as the piece-up operation is concluded.

The invention disclosed herein addresses these problems by providing a simple lift device which automatically lifts a package in response to a sensed condition and resets itself to permit lowering of the package into contact with the drive roll.

SUMMARY OF THE INVENTION

A package lift device according to this invention employs a lever assembly adapted to engage a substantially vertical member which depends from the package support of the winding apparatus. The lever assembly is provided with an opening for receiving the vertical member. The lift device is so constructed that the lever assembly engages and raises the vertical member, and consequently the yarn package, in response to a detected condition.

The lever assembly utilizes the binding action caused by rotation of a portion of the lever assembly with respect to the vertical member to create the frictional force utilized in engaging the member at the opening. In the preferred embodiment of the invention the lever assembly has a lever mounted for rotation about a movable pivot, the vertical member extending through an opening in the lever, said opening displaced from the pivot. Upon detection of a yarn break or other condition, the movable pivot is raised thus causing slight rotation of the lever. This movement results in a bending moment being created at the opening and causes the member to be frictionally engaged by the lever at the opening. Due to this engagement further raising of the pivot results in the vertical member being raised and the yarn package being lifted off of the drive roll.

The lift device is so constructed that the lever assembly can be returned to its original position by simply relaxing the downward pressure exerted through the vertical member. This resetting action may be accomplished by biasing the lever assembly towards its original position in a manner such that the biasing force is effective to return the lever assembly only when the downward pressure exerted through the vertical member is relaxed.

A more complete understanding of the invention and its operation, as well as other objects and advantages, will be apparent from the following detailed description of the invention taken in conjunction with the drawing figures.

DETAILED DESCRIPTION OF THE PREFERRED EMBODIMENT

Figure 1:
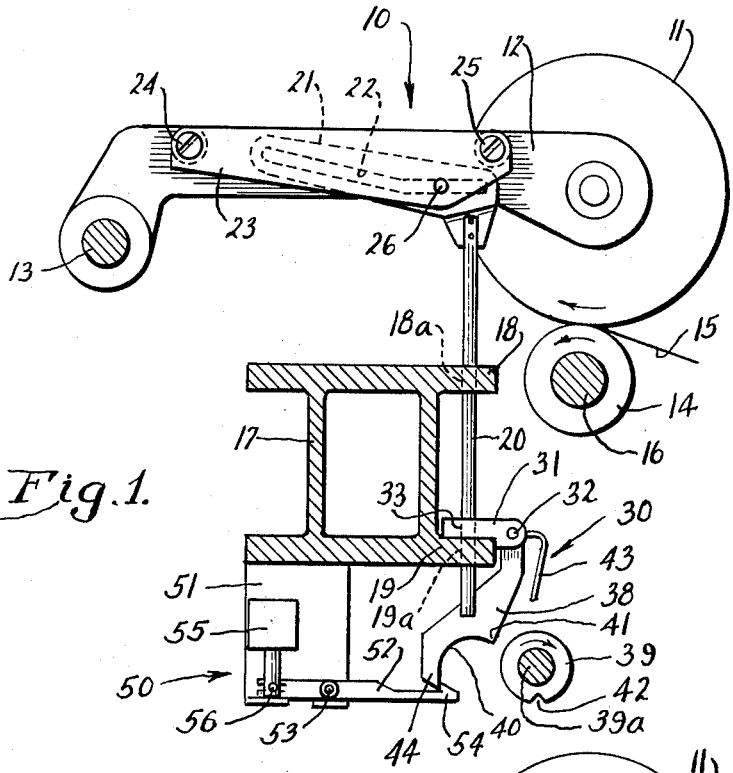
FIG. 1 is a partial side view of a winding station showing a preferred embodiment of the lift device of the invention in the winding position.

Referring more particularly to the drawings, FIG. 1 shows a typical winding station, generally indicated at 10, used in winding yarn onto a package. The particular embodiment shown and described is useful in connection with open-end spinning machines having individual spinning stations and associated winding stations. However, it would be readily apparent to those skilled in the art that the principles of the invention can be utilized in connection with winding apparatus in general.

Figure 2:
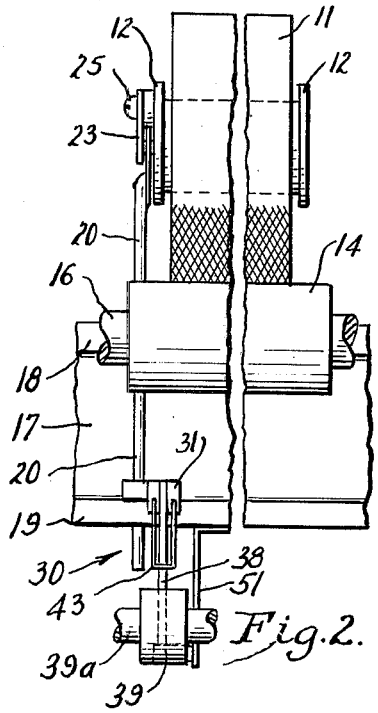
FIG. 2 is a partial front view of FIG. 1.

Winding station 10 has a yarn package 11 supported by suitable means such as package support arm 12 which is mounted for rotation about stationary shaft 13. Thus, yarn package 11 can be raised or lowered as desired by rotating support arm 12 about shaft 13. During winding yarn package 11 is lowered into contact with a rotating package drive roll 14 so that package 11 is rotationally driven by frictional contact with drive roll 14, thus causing yarn strand 15 to be wound on package 11. As shown in FIGS. 1 and 2, package drive roll 14 is mounted on shaft 16 which is in turn driven in conventional manner by apparatus not shown.

Tubular I-beam 17 is a supporting member of the machine of which winding station 10 is a portion. I-beam 17 is conveniently utilized as a support member for various components of the machine and may also be conveniently used to support components of the lift device of the invention disclosed herein.

The components of a preferred embodiment of the lift device according to the invention will now be discussed in more detail. As best seen in FIG. 1, a substantially vertical member such as shaft 20 extends through openings 18*a*, 19*a* of respective upper and lower flanges 18, 19 of I-beam 17. Openings 18*a* and 19*a* are preferably just large enough to permit freedom of movement through them by shaft 20 while at the same time maintaining shaft 20 in substantially vertical alignment.

Proximate to its top end, shaft 20 is provided with a bracket 21 having a slot 22. Support arm 12 has an associated retaining bracket 23 which is preferably fixed to arm 12 as by screws 24 and 25. Retaining bracket 23 is provided with a guide pin 26 and is mounted on support arm 12 such that guide pin 26 is located in slot 22 of bracket 21. This construction permits vertical shaft 20 to move freely in openings 18*a*, 19*a* without binding as package 11 is raised or lowered.

Figure 6:
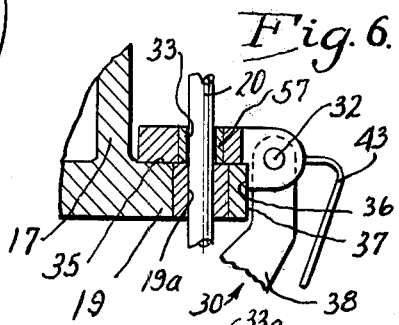
FIG. 6 is a side view, partially in section, of a portion of the lift device in the position shown in FIG. 1.

Winding station 10 is provided with a lever assembly generally indicated at 30, which is adapted to selectively engage and raise shaft 20. Lever assembly 30 has a lever 31 mounted for rotation about pivot 32. Lever 31 is provided with an opening 33 extending therethrough. While opening 33 may take various forms, such as a notch, it is preferably formed as a hole through lever 31 having a shape corresponding to that of shaft 20. As shown in FIG. 1, shaft 20 extends through opening 33. As best seen in FIG. 6, lever 31 is so constructed that it can be supported and located in position by shaft 20 and flange 19. The bottom surface 34 of lever 31 rests on the top surface 35 of flange 19. Lever 31 is provided with a lip 36 extending over the end 37 of flange 19. With this arrangement lever 31 can simply rest on flange 19 and be maintained in a proper position.

According to the invention, raising pivot 32 causes lever 31 to engage shaft 20 at opening 33. Further raising of pivot 32 results in lifting of shaft 20, support arm 12 and package 11. This action is described in more detail below. Means is provided to selectively operate the lever assembly 30 so that the engaging and lifting action takes place only at the desired time. Numerous mechanisms could be employed to accomplish this lever operating action. In the preferred embodiment this operating means comprises an operator which is employed to selectively engage a part of lever assembly 30 in a manner which causes pivot 32 to be raised. The operating means may also comprise additional apparatus to control the engagement of the lever assembly 30 by the operator. The preferred construction is discussed in more detail below.

Figure 3:
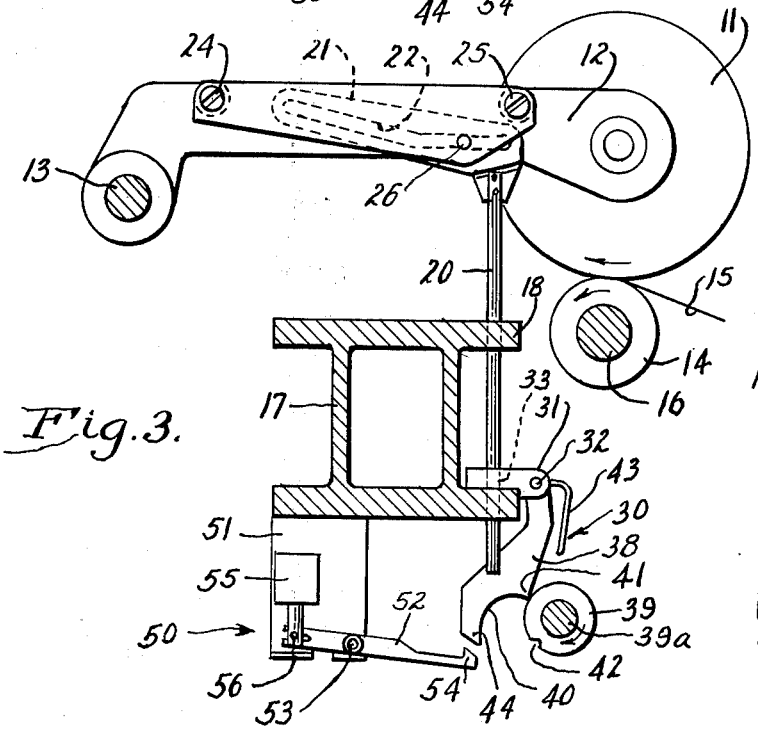
FIG. 3 is a partial side view of the winding station of FIG. 1 at the initiation of the lift operation.
Figure 4:
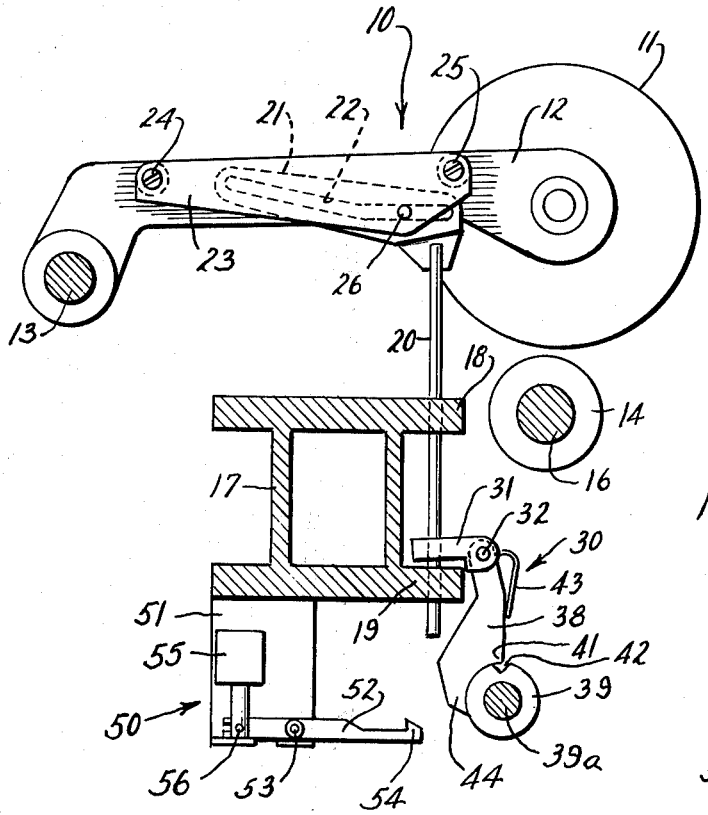
FIG. 4 is a side view of the winding station of FIG. 1 in the lifted position.
Figure 5:
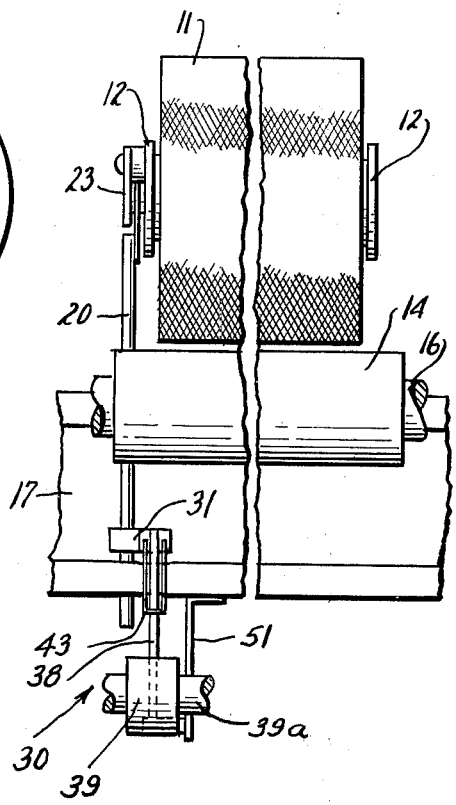
FIG. 5 is a front view of the winding station in a position shown in FIG. 4.

Referring again to FIGS. 1 and 2, lever assembly 30 also has a lift arm 38 connected to lever 31 at pivot 32 to permit relative rotation therebetween. The purpose of arm 38 is to provide a mechanism by which pivot 32 may be raised thus causing lever 31 to engage and lift shaft 20. In the preferred embodiment this is accomplished by providing an operator such as cam 39 which is adapted to engage and raise lift arm 38. In this construction, lift arm 38 is provided with a cam follower surface 40 having a leading edge 41. Cam 39 is mounted on rotating shaft 39*a* and is adapted to engage leading edge 41 of follower surface 40 when it is necessary to lift yarn package 11 in response to a detected condition. Shaft 39*a* is driven in any convenient manner and preferably rotates continuously during winding. To accomplish this engagement, cam 39 is provided with at least one notch 42. Depending on how fast shaft 39*a* rotates, it may be desirable to provide two, three or more such notches in cam 39 to shorten the response time. The cam action is best seen in FIGS. 3 and 4. Lift arm 38 is movable between a retracted position and an operating position. The retracted position is shown in FIG. 1 and it is apparent that the lift operation cannot take place when arm 38 is in this position. When yarn package 11 is to be raised, arm 38 is permitted to move, as by the force of gravity, from the retracted position and leading edge 41 contacts cam 39. As the cam rotates clockwise, notch 42 will engage leading edge 41 and lift arm 38 will be brought to the position shown in FIG. 4 (the operating or lift position).

Lever assembly 30 is also provided with means to bias lift arm 38 toward the retracted position to facilitate resetting the lift device. In the embodiment shown this biasing means comprises spring 43 which may be connected to the lever assembly in any suitable fashion. The operation of this biasing means is explained in more detail below.

In order to insure that the lifting operation takes place only at the desired times, it is necessary to provide means for selectively controlling the engagement of leading edge 41 by cam 39. In the preferred embodiment, this is accomplished by a latch assembly generally indicated at 50. A bracket 51 is fixed to and depends from I-beam 17. A latch arm 52 is preferably mounted for rotation about pin 53 and is provided with a latching portion 54 which is adapted to engage a portion 44 of lift arm 38 as shown in FIG. 1. Thus, when in the position shown in FIG. 1 latch arm 52 will retain lift arm 38 in a retracted position so that it is out of contact with cam 39. Initiation of the lifting operation may be accomplished by moving latching portion 54 out of engagement with portion 44 as by rotating latch arm 52 counterclockwise. This releases lift arm 38 so that it moves into contact with cam 39 as shown in FIG. 3. While various mechanisms could be employed, selective operation of latch arm 52 is accomplished in the preferred embodiment by providing solenoid 55 fixed to bracket 51 and operatively connected to latch arm 52 at pin 56. Solenoid 55 is preferably of the one-shot type and rotates latch arm 52 between latching and disengaged positions in response to a detected condition. After lift arm 38 is released latch arm 52 returns to its original position due to deenergization of solenoid 55 to facilitate resetting the lift device.

The operation of the lift device will now be discussed in more detail. During winding of the yarn on yarn package 11 the components of the package lift device will be in the positions shown in FIG. 1. When solenoid 55 receives a signal in response to a break in the yarn being wound or other detected condition solenoid 55 operates to rotate latch arm 52 out of engagement with lift arm 38. This releases lift arm 38 from the retracted position and it moves, typically by its own weight, into engagement with cam 39 as shown in FIG. 3. Spring 43 is so constructed and arranged that it is not effective to prevent engagement of leading edge 41 by cam 39 after release by latch arm 52. As shown in FIGS. 1, 3 and 4, spring 43 is not in contact with lift arm 38 until after engagement of edge 41 by notch 42. As cam 39 rotates clockwise notch 42 engages leading edge 41 so that lift arm 38 is raised and brought to the operating or lift position shown in FIG. 4. In the meantime, solenoid 55 has returned latch arm 52 to its original position. As lift arm 38 is raised the pivot 32 is also raised and lever 31 rotates slightly counterclockwise. This action causes a binding action at opening 33 resulting in frictional engagement of shaft 20 by lever 31. Further raising of pivot 32 results in raising shaft 20 and support arm 12. Consequently, package 11 is lifted off of package drive roll 14.

Figure 7:
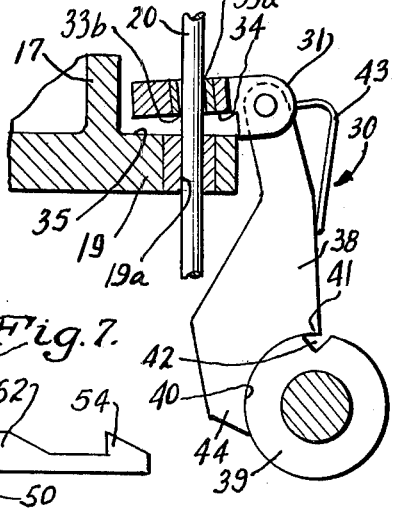
FIG. 7 is a side view, partially in section, of a portion of the lift device in the position shown in FIG. 4.
Figure 7:
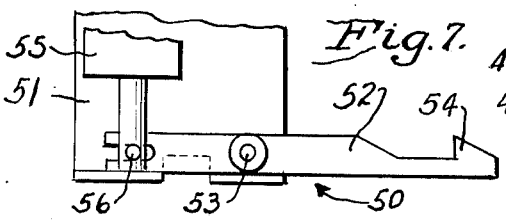

The engaging operation of lever 31 can best be seen in FIGS. 6 and 7. In order to achieve satisfactory engagement of shaft 20 when pivot 32 is raised, the relative dimensions of shaft 20 and opening 33, as well as the height of lever 31 at opening 33, are selected so that the binding action resulting from rotation of lever 31 produces a frictional force great enough to support package 11, support arm 12 and shaft 20. As shown in FIG. 7, the rotation of lever 31 caused by raising pivot 32 results in a binding effect wherein shaft 20 is engaged on opposite sides by a top edge 33*a* and a bottom edge 33*b* of opening 33. The resulting frictional force must be great enough to support the weight exerted by the yarn package 11, support arm 12 and shaft 20. It will be readily apparent that if the clearance between shaft 20 and the sides of opening 33 is too small the binding action will not provide a large enough frictional force to support the weight required. In such a case slippage will occur between shaft 20 and lever 31 and package 11 will not be lifted off of the drive roll 14. Similarly, for a given clearance, the binding effect may not be sufficient if the height of lever 31 at opening 33 is too great. These selections will also be affected to a certain degree by the coefficient of friction of the materials used for shaft 20 and lever 31.

In practice it has been found that the clearance can be rather small and still permit lever 31 to develop the necessary frictional force for engaging and lifting shaft 20. Further, this can be accomplished with a relatively small movement of pivot 32. In actual operation, engagement of shaft 20 by lever 31 occurs almost immediately after engagement of leading edge 41 of cam follower surface 40 by notch 42 of cam 39 and subsequent raising of lift arm 38 to the position shown in FIG. 4 results in the corresponding raising of shaft 20 and package support arm 12.

In connection with engagement of shaft 20 potential exists for wear problems at opening 33 due to repeated lift operations. An additional feature contained in the preferred embodiment is shown in FIGS. 6 and 7. Opening 33 is preferably formed by providing a hardened sleeve 57 inserted in a sufficiently large opening in lever 31 so as to minimize the effects of wear.

It will be noted that as yarn is wound yarn package 11 gets larger and support arm 12 moves upward. Since a yarn break may occur at any time it is necessary that the lift device be capable of operating in the same manner whether the package is large or small. By utilizing a device capable of engaging shaft 20 at any point, the invention satisfies this critical requirement.

After the yarn break or other detected condition is corrected it is necessary to again lower the package 11 into contact with package drive roll 14 so that the winding operation may continue. Consequently, it is necessary to insure that the package lift device can be deactivated so as to permit lowering of the yarn package. The lift device of the invention is so constructed that relaxing the downward pressure exerted by yarn package 11, package support arm 12 and shaft 20 results in automatic disengagement of lever 31 from shaft 20 thus permitting package 11 to be lowered.

In the embodiment described, the continuous clockwise rotation of cam 39 while in contact with cam follower surface 40 creates a frictional force which tends to keep lift arm 41 in the operating position shown in FIG. 4. The weight of yarn package 11, support arm 12 and shaft 20 provides an additional component to this frictional force. Spring 43 is selected so that it is not strong enough to overcome the frictional force existing between cam 39 and cam follower surface 40 when the weight of package 11, arm 12 and shaft 20 are acting on lever assembly 30. However, if the downward pressure exerted by these components is relaxed, spring 43 is strong enough to overcome the remaining frictional force existing between cam 39 and cam follower surface 40. Relaxing of this pressure can be accomplished by simply raising support arm 12 slightly. This may be done manually after piece-up of the broken yarn or correction of any other detected condition. If the machine is provided with apparatus to automatically piece-up, this apparatus could be adapted to slightly raise support arm 12 during the piece-up operation. Once the downward pressure is relaxed the frictional force between cam 39 and surface 40 decreases and spring 43 acts to move or kick lift arm 38 toward the retracted position out of engagement with cam 39 and lever assembly 30 drops to its original position as shown in FIG. 1. Thus, spring 43 will not cause disengagement until the downward pressure is relaxed. When spring 43 moves lift arm 38 toward a retracted position portion 44 will again be latched by latch arm 52, the momentum of arm 38 being sufficient to permit portion 44 to momentarily depress latching portion 54 when contact is made so that portion 44 moves past latching portion 54 to again be retained thereby.

The invention thus provides a package lift device of relatively simple construction which will lift yarn package 11 off of drive roll 14 in response to a detected condition at any time during the winding operation. Further, the device is so constructed that resetting of the package lift device is accomplished in a very simple manner. It will be readily apparent to those skilled in the art that various modifications and alternate constructions employing the principles of the invention may be utilized without departing from the scope and spirit of the invention. The embodiment described is intended to be exemplary only and the invention is limited solely by the claims.

That which is claimed is:

1. In a yarn winding device having means to support a yarn package in contact with a rotating package drive roll, a package lift device adapted to automatically lift the yarn package off of the package drive roll in response to a detected condition, said package lift device comprising: a substantially vertically oriented member associated with and depending from said yarn package support means; a lever assembly comprising a movable pivot, a lever mounted for rotation about said pivot, an opening in said lever displaced from said pivot, said member extending through said opening; means for selectively operating said lever assembly in response to a detected condition to raise said pivot whereby said lever rotates, frictionally engages said member at said opening and raises said member so as to lift the yarn package, said operating means comprising an operator disengaged from said lever assembly prior to condition detection and means for causing engagement of said lever assembly and said operator in response to said condition detection.

2. A package lift device as in claim 1 additionally comprising means to bias said lever assembly such that said lever assembly disengages from said member in response to relaxation of the downward pressure exerted by said support means and said member.

3. A package lift device as in claim 1 said lever assembly additionally comprising a lift arm rotatably connected to said lever at said pivot and movable between a retracted position displaced from said operator and an operating position, said operator adapted to engage and move said lift arm to said operating position so as to raise said pivot.

4. A package lift device as in claim 3 additionally comprising means to bias said lift arm towards said retracted position such that said lift arm is disengaged from said operator in response to relaxation of the downward pressure exerted by said support means and said member.

5. A package lift device as in claim 4 wherein said biasing means comprises a spring.

6. A package lift device as in claim 3 wherein said lift arm has a cam follower surface and said operator comprises a cam adapted to engage said lift arm at said cam follower surface.

7. A package lift device as in claim 6 wherein said cam has a notch for engaging a leading portion of said cam follower surface.

8. A package lift device as in claim 3 wherein said operating means additionally comprises means to selectively retain said lift arm in said retracted position.

9. A package lift device as in claim 8 wherein said retention means comprises a latch arm having a latching portion adapted to engage a portion of said lift arm when said lift arm is in the retracted position.

10. A package lift device as in claim 9 wherein said operating means additionally comprises means to move said latching portion out of engagement with said lift arm in response to a detected condition.

11. A package lift device as in claim 10 wherein said latch arm is pivotally mounted to permit selective disengagement of said latching portion by rotation of said latch arm.

12. A package lift device as in claim 11 wherein said moving means comprises a solenoid.

* * * * *